United States Patent [19]

Poynter

[11] 4,432,542

[45] Feb. 21, 1984

[54] JOKE CIGARETTE LIGHTER

[75] Inventor: Donald B. Poynter, Cincinnati, Ohio

[73] Assignee: Poynter Products, Inc., Cincinnati, Ohio

[21] Appl. No.: 277,036

[22] Filed: Jun. 24, 1981

Related U.S. Application Data

[63] Continuation of Ser. No. 56,050, Jul. 10, 1979, abandoned.

[51] Int. Cl.[3] ..... A63H 33/30

[52] U.S. Cl. ..... 272/27 W; 251/74; 251/115; 431/254

[58] Field of Search ..... 272/27 R, 27 B, 27 N, 272/27 W; 431/254, 255, 256, 257, 274, 275, 276, 277, 129, 144; 251/74, 66, 89, 111, 115, 114, 116, 297

[56] References Cited

U.S. PATENT DOCUMENTS

| | | | |
|---|---|---|---|
| 2,607,627 | 8/1952 | Gregg et al. | 251/74 X |
| 2,941,418 | 6/1960 | Esser et al. | 251/115 X |
| 3,178,077 | 4/1965 | Benedetto | 251/115 X |
| 3,890,087 | 6/1975 | Jackson | 431/254 X |

FOREIGN PATENT DOCUMENTS

| | | | |
|---|---|---|---|
| 1063548 | 12/1953 | France | 272/27 W |

*Primary Examiner*—Robert A. Hafer
*Assistant Examiner*—Arnold W. Kramer
*Attorney, Agent, or Firm*—Kinney and Schenk

[57] ABSTRACT

A novelty device resembling a cigarette lighter in appearance has a bi-stable actuator mounted on the container to expel a foam-like substance from the container whenever a user depresses the actuator.

3 Claims, 4 Drawing Figures

JOKE CIGARETTE LIGHTER

This is a continuation of application Ser. No. 056,050, filed July 10, 1979, and now abandoned.

BACKGROUND

The present invention relates generally to novelty devices and more particularly to a joke cigarette lighter which gives an unsuspecting user an unsuspected surprising and shocking effect when he/she attempts to ignite the lighter.

Cigarette lighters are in wide spread use throughout the world. Smokers use cigarette lighters on a frequent and rather casual basis. One type of cigarette lighter with which many cigarette smokers are familiar has a fuel container commonly encapsulated in a plastic with a valved opening on an end portion of the container. A rotary friction member is mounted proximal to the opening. This friction member generally engages a flint and produces a spark which is directed toward the opening when the friction member is rotated. An actuator, commonly in the form of a lever, is positioned near the friction member and serves to open the valve opening whenever depressed. The actuating lever and the friction member have a relative position such that when a human user utilizes his/her thumb to rotate the friction member to direct a spark toward the valve opening, the thumb would roll off of the friction member and depress one end of the actuating lever which serves to open the valve opening. When the end of the actuator lever is depressed, the opposite end of the lever serves to open the valve opening and permit fuel to escape to the atmosphere. When the fuel is combined with air and subjected to a spark directed from the interaction of the flint and the friction member, a flame results. This flame generally continues until the actuator lever is released. When the user releases his/her thumb from the actuator lever, the valved opening is closed and the remaining fuel in the container is prevented from escaping from the container.

It is an object of the present invention to provide a container which closely resembles a conventional cigarette lighter in apearance but which will produce a novelty effect.

It is a further object of the present invention to provide a container which closely resembles a conventional cigarette lighter in appearance but in which the valved opening which connects the container contents to the atmosphere will not close when pressure is released from the actuating lever.

It is a further object of the present invention to provide a container which closely resembles a conventional cigarette lighter in appearance and which expels a foam-like substance from the container contents when the valve is opened.

SUMMARY OF THE INVENTION

In accordance with the invention a novelty device includes an enclosed fluid container with a valve means thereon movable between open and closed positions. The valve means is operable to selectively establish fluid communication between the interior of the container and the atmosphere when the valve is in the open position. The invention also includes means for expelling fluid within the container whenever fluid communication between the interior of the container and the atmosphere is established. A friction means is rotatably supported on the exterior of the container and is adapted to interface with a human finger. The device includes a bi-stable actuator mounted on the container which cooperatively interacts with the valve means to move the valve between open and closed positions. One of the stable positions of said actuator corresponds to an open position of the valve and the actuator remains in the open position when external pressure is removed from the actuator. The container preferably contains a non-combustible foam-like substance that is rapidly expelled whenever fluid communication is established with the atmosphere. Such an expulsion of the foam-like substance gives an unsuspecting user a surprising effect.

In the preferred embodiment, the bi-stable actuator includes a lever arm pivotally mounted on the exterior of the container and a holding member resiliently urged against an end of the lever arm. The holding member cooperates with the lever arm to hold the valve at two stable positions, one of the stable positions corresponding to a closed opening of the valve and the other stable position corresponding with an open position of the valve.

BRIEF DESCRIPTION OF THE DRAWINGS

Other objects and advantages of the invention will be apparent upon reading the following detailed description and upon reference to the drawings, in which.

While the invention will be disclosed in connection with a preferred embodiment, it will be understood that it is not intended to limit the invention to that embodiment. On the contrary, it is intended to cover all alternatives, modifications, and equivalents as may be included when the spirit and scope of the invention is defined by the appended claims.

DETAILED DESCRIPTION OF THE PREFERRED EMBODIMENT

Figure 1:
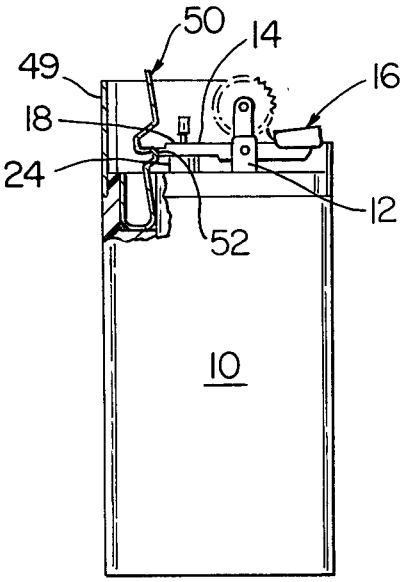
FIG. 1 is a cross sectional elevational view of an apparatus resembling a conventional cigarette lighter in appearance utilizing one form of the present invention.
Figure 3:
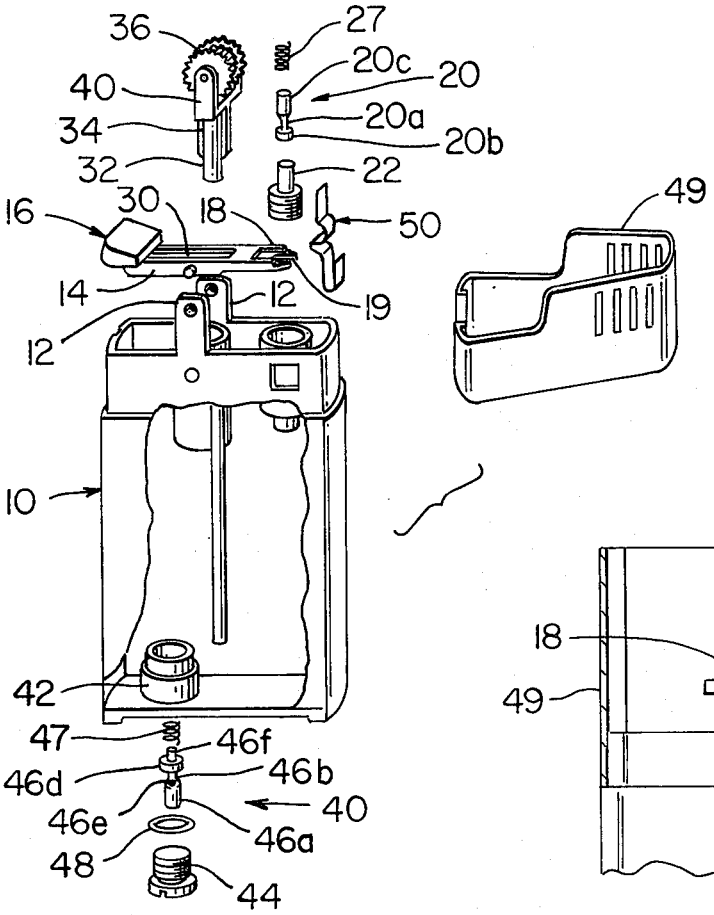
FIG. 3 is an exploded perspective view of the apparatus of FIGS. 1 and 2.

Referring now to the drawings and to FIGS. 1 and 3 in particular, a container 10 in the form of a plastic shell is shown. The shell 10 has a pair of vertical supports 12 (only one of which is shown in FIG. 1, the remaining vertical support is clearly illustrated in FIG. 3) which are mounted on the top of the container and which pivotally support an acutator or lever arm 14. One end of the lever arm has an enlarged bearing surface 16 which in practice is depressed by the user's thumb. The opposite end 18 of the lever arm 14 has an open ended slot 19 which fits about a portion 20*a* of a valve stem 20 which has a reduced cross sectional area.

The valve stem 20 is movably fitted within a valve body 22 of a valve 24. The valve body 22 is in turn threadably received by an opening 25 in the container. A spring 27 biases the valve stem 20 downwardly into the valve body 22 to seat a bottom portion 20*b* the stem 20 inside the valve body 22. When in the seated or closed position, the valve 24 precludes expulsion of the pressurized fluid contents to the atmosphere.

When a sufficient downward force is applied against the bearing surface 16 of the lever arm 14, the lever arm rotates about its pivotal axis and the opposite end 18 of the lever arm 14 is moved upwardly. When this upward movement of the lever arm end 18 occurs, that portion 18 of the lever arm engages the underside of an enlarged end portion 20*c* of the valve stem 20. This enlarged end portion 20*c* is adjacent to the stem portion 20*b* of reduced cross sectional area about which the end 18 of lever arm 14 is engaged. Force applied to the underside of valve end portion 20*c* overcomes the spring bias of valve 24 and unseats the valve. Fluid communication between the container 10 contents and the atmosphere is then established with this unseating of the valve and the pressurized contents of the container are forced by the pressure differential to pass through the valve 24 and to be expelled to the atmosphere.

As shown in FIG. 3, the lever arm 14 also contains a central bore 30 through which a stem 32 of a support 34 for a rotary friction member 36 extends. A yoke 40 is supported atop the stem 32 and this yoke 40 in turn supports a rotary friction member 36. A metal protective shield 49 is fitted on the container 10 and substantially surrounds the lever arm 14.

The container 10 has a refill valve 40 on its underside. The refill valve 40 includes a tiered cylindrical housing 42 commonly formed of plastic which threadably receives a housing end portion 44 which is commonly formed of brass. The housing end portion 44 has a central bore therethrough into which an end portion 46*a* of a valve stem 46 extends. The stem 46 also has a central bore (not shown) which extends through the end portion 46*a* into an intermediate portion 46*b* of reduced cross sectional area and having an opening 46*e*. The reduced intermediate portion 46*b* is disposed between the end portion 46*a* and an enlarged seat portion 46*d*. A spring guide 46*f* extends from the seat portion 46*d* and guides movement of a spring 47 which normally urges the seat 46*d* against a resiliant washer 48 which sits atop the housing end portion 44. As is well known in the art, the refill valve 40 is used to refill the container contents.

The structure described thus far is that of a conventional cigarette lighter of the type commercially available and widely used. In normal operation, a user takes his/her thumb and applies a tangential force on the periphery of the rotary friction member 36 to force that member clockwise in the illustration of FIG. 1 or counter-clockwise in the illustration of FIG. 3.

In a conventional cigarette lighter, the stem 32 is adapted to house a flint which engages the underside of the rotary friction member 36. When the friction member 36 is rotated, a spark is generated and directed toward the valve 24. Continued movement of the user's thumb after rolling off the friction member 36 carries the thumb onto the bearing surface 16 of the lever arm 14 and forces that end of the lever arm 14 downward. The opposite end 18 of lever arm 14 is forced upwardly and when sufficient force is applied to the bearing surface 16, the bias of spring 27 in valve 24 is overcome. Upward movement of the valve stem 22 unseats the valve 24 and establishes fluid communication between the container contents and the atmosphere, releasing the pressurized fuel into the area into which the spark from the flint was directed. Combustion of the fuel generally results. When the user has lit his/her cigarette, pressure is generally released from the bearing surface 16 and the bias of spring 27 forces downward movement of the stem 22, which in turn ceases fuel flow and prohibits further fluid communication between the container contents and the atmosphere. The flame is, of course, extinguished when the flow of fuel is ceased.

Figure 2:
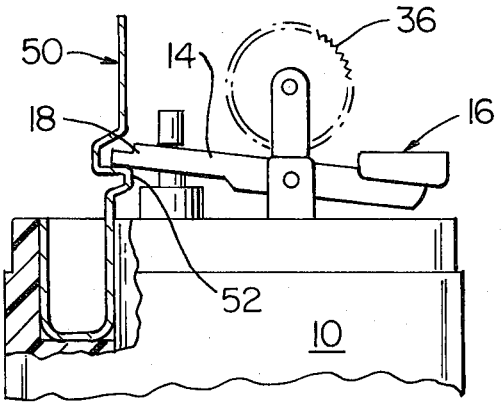
FIG. 2 is an enlarged cross sectional elevational view of a portion of the apparatus of FIG. 1 with the protective shield removed for clarity of illustration.

Applicant has made several important changes in the structure described above which modify a conventional cigarette lighter into a novelty apparatus. As shown in the depictions of FIGS. 1–3, a resilient holding member 59 is fitted into a cavity of the container 10 between the valve 24 and a side wall. In the illustrated form, the holding member is a metal clip with an outwardly protruding section 52. The illustration of FIG. 1 shows the apparatus in a closed position. In this position, the end 18 of the lever arm 14 engages the holding member below the outbearing surface 16, the opposite end 18 of the arm 14 deflects the holding member 52 backwards (leftwardly in the illustrated depiction of FIG. 1) to permit the end 18 of the lever arm 14 to move to the topside of the outwardly protruding member 52 as shown in FIG. 2. When the lever end 18 so moves to the topside of the outwardly protruding portion 52, the resilient holding member 50 slides under the lever arm end 18 and prevents the spring bias of the valve 24 from returning that valve to the seated or closed position. Thus, the valve is held open even after pressure is removed from the bearing surface 16. Moreover, instead of combustible fuel, the container contains a mixture of foam and water. Further, no flint is used to engage the rotatory friction member 36 as no spark is necessary.

When the novelty lighter of the present invention is used, an unsuspecting user takes the lighter and rotates the friction member and depresses the lever at the bearing surface 16. This depression of the lever arm 14 opens the valve 24 in a manner which is highly analogous to that undergone when a user ignites a conventional cigarette lighter. However, once the valve is open, instead of gas flame, a foam and water solution in the container contents are rapidly expelled creating a shocking novelty effect on the user. The natural reaction to such a shocking experience on the part of the user is to release the lever arm 14. However, the actuator of the present invention is bi-stable with one of the stable positions corresponding to the open position of the valve as shown, for example in FIG. 2. Consequently, when pressure is released from the bearing surface, the valve remains in the open position, and the entire container contents are expelled.

For reasons of economy, a standard refillable lighter is preferably modified and used for the present invention when an apparatus designed to hold the gas valve open after force is removed from the valve actuator. The valve of this conventional lighter is adjusted to allow a very rapid flow of the container contents. It is also advisable to remove the flint in case the lighter is accidentally filled with real lighter gas since, as mentioned above, the rapid release of this gas could prove to be dangerous.

Figure 4:
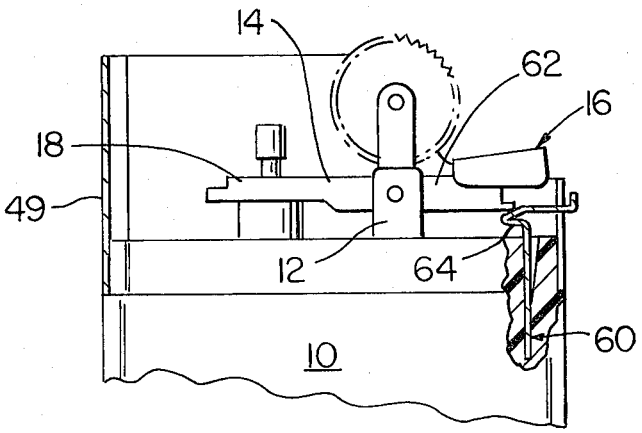
FIG. 4 is a partial cross sectional elevational view of an apparatus using an alternate embodiment of the invention from that depicted in FIGS. 1 and 2.

Referring now to FIG. 4, an alternate form of the present invention is illustrated. In this embodiment a holding member 60 is positioned proximal to the bearing surface and of an actuator 62. Like the holding member 50 in FIGS. 1 and 2, holding member 60 has an outwardly protruding portion 64 which is adapted to interface with the end of the lever arm 62. In this embodiment when the bearing surface end of the lever 62 is depressed, the holding member 60 is forced rightwardly in the illustration to permit the bearing surface end of the lever 62 to be depressed. Once the bearing 62 has moved to the open position, however, the portion 64 of the holding member 60 will be on the topside of the lever arm 62 preventing closing of the valve member connected to the opposite end of the lever arm 62.

Thus, it is apparent that there has been provided, in accordance with the invention, an apparatus that fully satisfies the objects, aims, and advantages set forth above. While the invention has been described in conjunction with a specific embodiment thereof, it is evident that many alterations, modifications, and variations will be apparent to those skilled in the art in light of the foregoing description. Accordingly, it is intended to embrace all such alternatives, modifications, and variations as fall within the spirit and scope of the appended claims.

What is claimed is:

1. A novelty apparatus, comprising:

(a) an enclosed fluid container having an opening;

(b) valve means associated with said container and movable between open and closed positions, said valve means being operable to selectively establish fluid communication between the interior of the container and the atmosphere, the interior of the container being in fluid communication with the atmosphere when said valve is in the open position;

(c) means for expelling fluid in said container whenever fluid communication is established between the interior of the container and the atmosphere;

(d) friction means rotatably supported on the exterior of said container, said friction means being adapted to interface with a human finger;

(e) a bi-stable actuator mounted on said container, said actuator cooperatively interacting with said valve means to move said valve means between open and closed positions, said actuator having one stable position corresponding to the open position of said valve means and one stable position corresponding to the closed position of said valve means, said bi-stable actuator including a lever arm pivotally mounted on the exterior of said container and a holding member resiliently urged against an end of said lever arm, said holding member cooperating with said lever arm to interface at two stable positions, one of said stable positions corresponding with a closed position of said valve means and the other stable position corresponding to an open position of said valve means, said holding member comprising an integral one-piece resilient clip member having opposed ends, one of said opposed ends of said resilient clip member being secured to said apparatus by being press-fitted into said opening of said container in a manner to cantilever mount the other of said opposed ends, said resilient clip member having an outwardly protruding section intermediate said ends thereof for acting on said end of said lever arm, said protruding section having opposed surfaces respectively engaging said end of said lever arm in said two stable positions.

2. A novelty apparatus as set forth in claim 1 wherein said one end of said resilient clip member is substantially straight.

3. A novelty apparatus as set forth in claim 1 wherein said one end of said resilient clip member is substantially U-shaped.

* * * * *